US009450350B2

(12) United States Patent
Chen et al.

(10) Patent No.: US 9,450,350 B2
(45) Date of Patent: Sep. 20, 2016

(54) CABLE CONNECTOR ASSEMBLY WITH IMPROVED LUMINOUS EFFECT

(71) Applicant: FOXCONN INTERCONNECT TECHNOLOGY LIMITED, Grand Cayman (KY)

(72) Inventors: Chi-Ming Chen, New Taipei (TW); De-Gang Zhang, Kunshan (CN); Zhi-Yang Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/920,058

(22) Filed: Oct. 22, 2015

(65) Prior Publication Data

US 2016/0118755 A1 Apr. 28, 2016

(30) Foreign Application Priority Data

Oct. 22, 2014 (CN) ..... 2014 1 0562927

(51) Int. Cl.

| | |
|---|---|
| ***H01R 3/00*** | (2006.01) |
| ***H01R 13/717*** | (2006.01) |
| ***H01R 13/66*** | (2006.01) |
| ***H01R 27/02*** | (2006.01) |

(52) U.S. Cl.

CPC ..... *H01R 13/717* (2013.01); *H01R 3/00* (2013.01); *H01R 13/665* (2013.01); *H01R 27/02* (2013.01)

(58) Field of Classification Search

CPC ..... H01R 3/00; H01R 13/71; H01R 13/717; H01R 13/7175; H01R 13/6616; H01R 13/6625; H01R 13/6641; H01R 13/6658; H01R 13/6666

USPC ..... 439/620.21–620.22, 490

See application file for complete search history.

(56) References Cited

U.S. PATENT DOCUMENTS

| | | | | |
|---|---|---|---|---|
| 6,165,006 | A * | 12/2000 | Yeh | H01R 13/6641 439/490 |
| 6,336,825 | B1 * | 1/2002 | Seefried | G02B 6/4204 439/488 |
| 7,004,595 | B1 * | 2/2006 | Stoddard | H01R 13/6641 362/114 |
| 7,393,237 | B2 * | 7/2008 | Kuo | H01R 13/6691 362/249.01 |
| 7,661,983 | B2 * | 2/2010 | Yang | H01R 4/02 439/490 |
| 7,744,231 | B2 * | 6/2010 | Hutchinson | G02B 6/0001 362/555 |
| 9,022,605 | B2 | 5/2015 | Bushnell et al. | |
| 2003/0100218 | A1 * | 5/2003 | Tsai | H01R 13/717 439/490 |
| 2003/0194906 | A1 * | 10/2003 | Arkin | H01R 13/717 439/490 |
| 2006/0039136 | A1 * | 2/2006 | Probasco | H01R 13/652 362/157 |
| 2006/0099999 | A1 * | 5/2006 | Park | H01M 10/488 455/573 |
| 2008/0003867 | A1 * | 1/2008 | Wu | H01R 13/6658 439/490 |

* cited by examiner

*Primary Examiner* — Chandrika Prasad

(74) *Attorney, Agent, or Firm* — Wei Te Chung; Ming Chieh Chang

(57) ABSTRACT

A cable connector assembly (100) comprises: a first connector (10) having a main body (120), a number of contacts (121) retained in the main body, a first circuit board (130) electrically connected to the contacts, and a metal shell (110) enclosing the first circuit board; a cable (30) electrically connected between the first circuit board and a power source to provide a power to the first circuit board; a second circuit board (150) vertically fixed on the metal shell; a cover enclosing the first and the second circuit board; a luminous element (152) disposed on a front side of the second circuit board and electrically connected to the first circuit board; and a translucent portion (1610) defined on a front end of the cover to pass light emitted by the luminous element.

20 Claims, 4 Drawing Sheets

CABLE CONNECTOR ASSEMBLY WITH IMPROVED LUMINOUS EFFECT

BACKGROUND OF THE INVENTION

1. Field of the Invention

The present invention relates to a cable connector assembly, and more particularly to a cable connector assembly having a luminous element to illuminate a mating area of the cable connector assembly.

2. Description of Related Art

A cable connector assembly is usually used to charge a rechargeable battery of a mobile electronic device. Some cable connector assemblies also have a light-emitting element to facilitate connection of the cable connector assembly to a mating connector of a charging apparatus.

U.S. Pat. No. 9,022,605 discloses a charging connection device including a device connector configured to be coupled to a rechargeable electronic device and a circuit board coupled to the connector and having a charging circuitry and associated light source. A housing encloses the circuit board and includes a first end having a lens. The connector extendes from the first end. A touch switch on the housing is coupled to the circuit board and configured to activate the light source.

However, the associated light source of the charging connection device is disposed directly on the circuit board, and the circuit board is assembled behind the device connector, which results in the light emitted by the associated light source is partially blocked and thus a poor illumination effect.

A cable connector assembly with an improved illumination effect is desired.

BRIEF SUMMARY OF THE INVENTION

Accordingly, an object of the present invention is to provide a cable connector assembly having improved illumination effect.

In order to achieve the above-mentioned object, a cable connector assembly in accordance with the present invention comprises: a first connector having a main body, a plurality of contacts retained in the main body, a first circuit board electrically connected to the contacts, and a metal shell enclosing the first circuit board; a cable electrically connected between the first circuit board and a power source to provide a power to the first circuit board; a second circuit board vertically fixed on the metal shell; a cover enclosing the first and the second circuit boards; a luminous element disposed on a front side of the second circuit board and electrically connected to the first circuit board; and a translucent portion defined on a front end of the cover to pass the light emitted by the luminous element.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
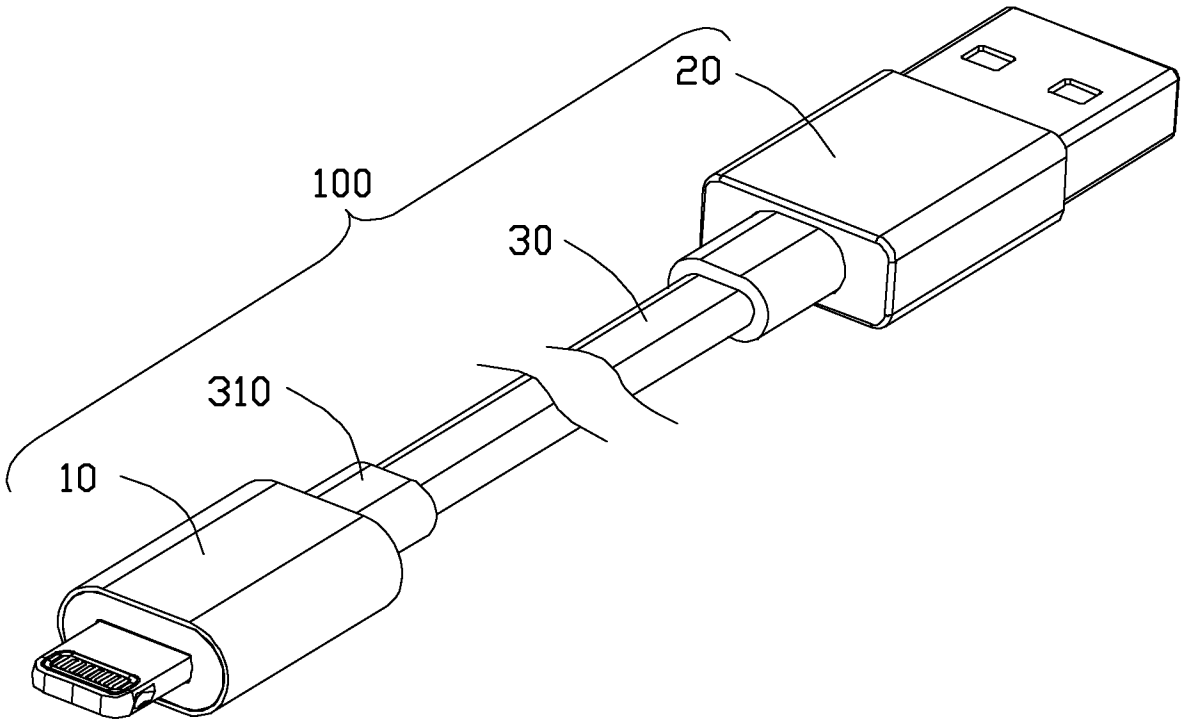
FIG. 1 is a perspective view of a cable connector assembly according to the present invention.

Referring to FIG. 1, a cable connector assembly 100 in accordance with the present invention comprises a first connector 10 for connecting with a mobile phone and other mobile electronic devices, a second connector 20 connecting to a power source (not shown) and a cable 30 electrically connected between the first connector 10 and the second connector 20. In the embodiment, the first connector is a lighting connector; the second connector is a USB connector. In other embodiments, the first connector 10 can be other types of connectors.

Figure 2:
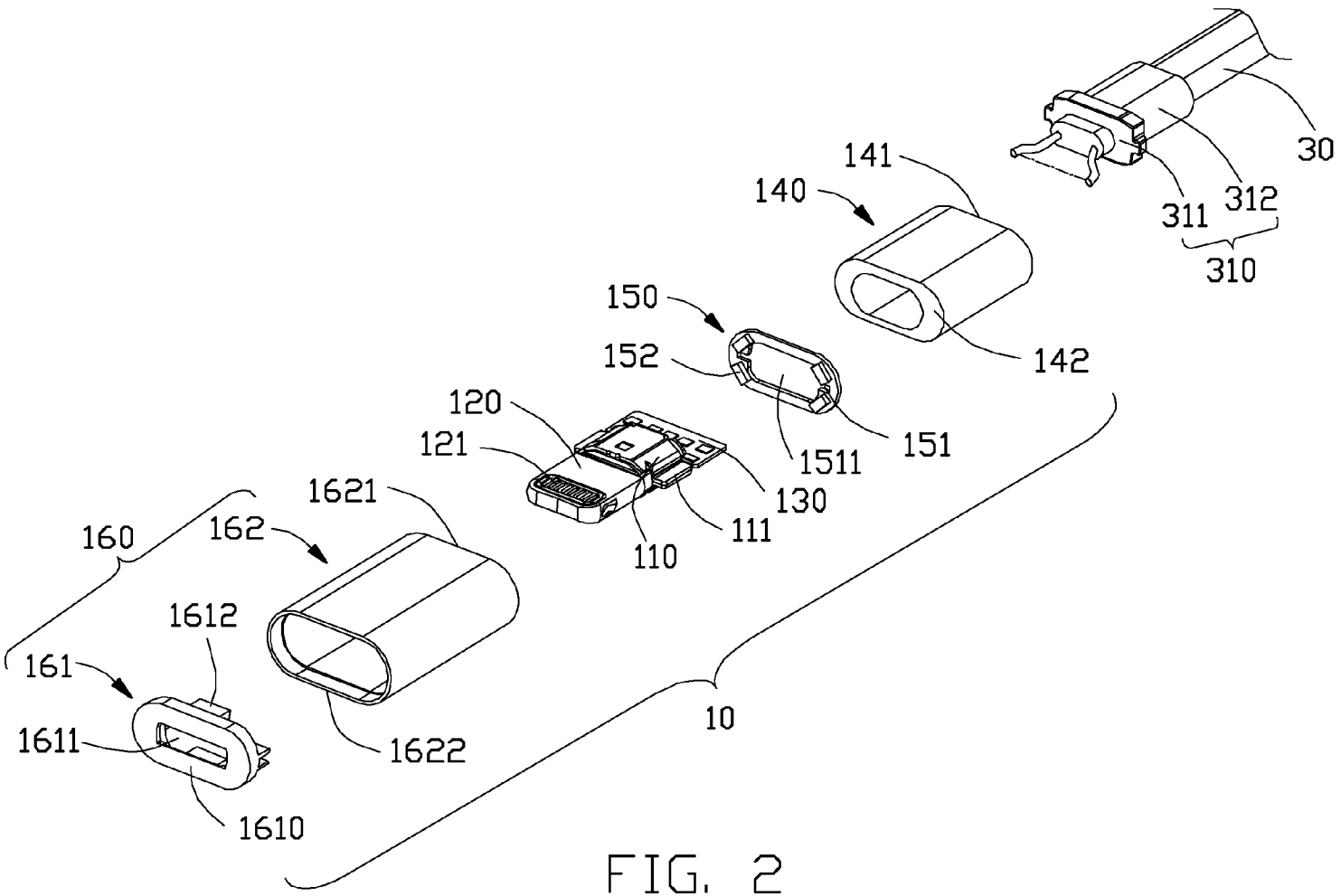
FIG. 2 is an exploded views of the cable connector assembly shown in FIG. 1.

Referring to FIG. 2, the first connector includes a main body 120, a number of contacts 121 retained in the main body 120 and exposed on two opposite sides of a front end of the main body 120, a first/horizontal circuit board 130 assembled on a rear end of the main body and electrically connected to the contacts 121, a metal shell 110 enclosing the first circuit board 130, an inner mold 140, a second/vertical circuit board 150, and a cover 160.

The metal shell 110 defines a fixing plate 111 extending along a horizontal direction on each of the opposite sides of the metal shell 110.

The second circuit board 150 is generally annular and defines a through hole 1511. A pair of notches 151 are defined on the opposite sides of the inner edge of the second circuit 150. A luminous element 152 is installed on a front side of the second circuit 150. The luminous element 152 is electrically connected to a power source of the first circuit board 130 via a pair of wires or conductors (not shown) including a power wire and a grounding wire, through which the luminous element 152 is powered by the first circuit board powered. The luminous element 152 is a light emitting diode, a semiconductor laser or other electronic components which can emit light. The switch way of the light mode of the luminous element 152 according to the present invention may be a light-emitting color conversion, a light-emitting dynamic conversion or a conversion combining colors conversion and dynamic conversion.

The cover 160 includes a front plate portion 161 and a tubular portion 162. The front plate portion 161 defines a translucent portion allowing light to pass through. A through hole 1611 is defined on the front plate portion 161 through the front side wall and the rear side wall of the front plate portion 161. A plurality of positioning portions 1612 are formed on the rear side wall of the front plate portion 161 around the through hole 1611.

In the embodiment, entire front plate portion 161 is defined as the translucent portion 1610. In other embodiments, the translucent portion 1610 may be only a part of the front plate portion 161. The translucent portion 1610 is made of transparent or translucent material. The tubular portion 162 defines a first end 1621 having a smaller opening and a second end 1622 having a larger opening.

Figure 3:
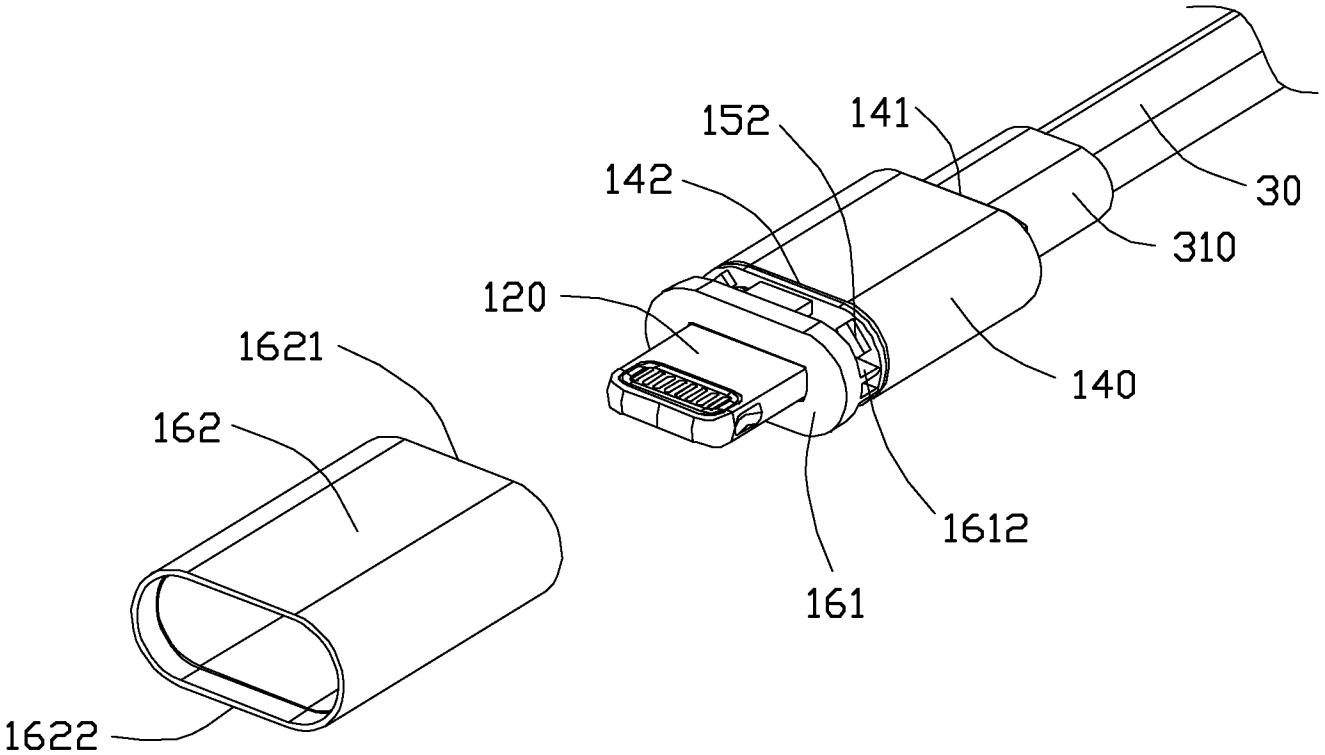
FIG. 3 is a perspective view of the cable connector assembly, in which the tubular portion disassembled form the cable connector assembly.
Figure 4:
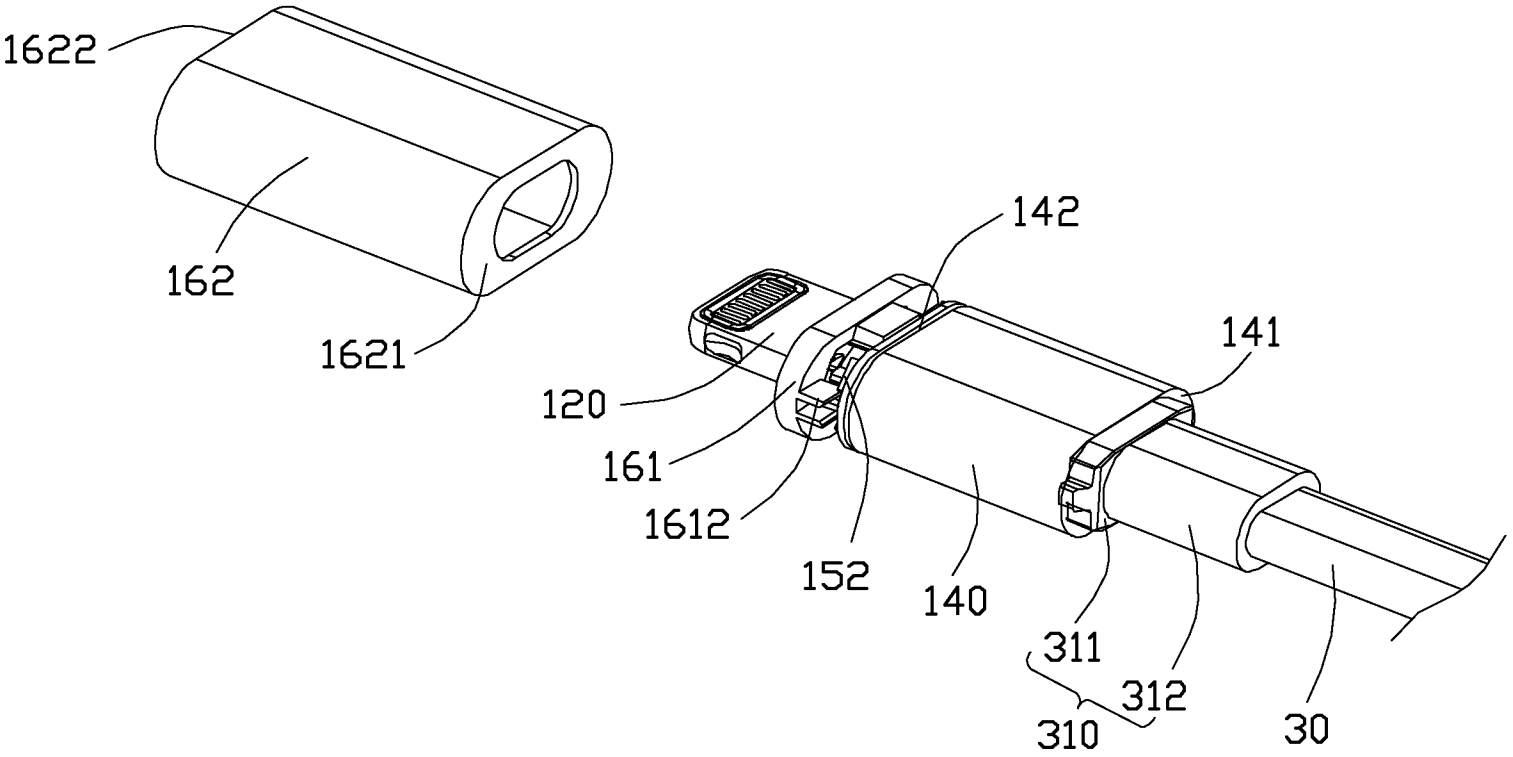
FIG. 4 is a perspective view similar to the FIG. 3, but from a different aspect.

Referring to FIGS. 2 to 4, when assembled, the internal wires (not labeled) of the cable 30 is soldered to the first circuit board 130. The inner mold 140 is molded on the conjunction portion of the cable 30 and the first circuit board 130. The inner mold 140 includes a first end 141 and an opposite second end 142. An end of the cable 30 forms a stress relief portion 310 comprising a fixing portion 311 on a front end and a holding portion 312 on a rear end thereof. The front end of the main portion 120 is passed through the though hole 1511 until the metal shell 110 is received in the through hole 1511 and the fixing plates 111 is received in the corresponding notch 151 of the second circuit board 150. A rear side wall of the second circuit board 150 is against the second end 142 of the inner mold 140. The second circuit board 150 is affixed to the metal shell 110 by glue. The front end of the main body 120 is further passed though the through hole 1611 of the front plate portion 161 until a rear side of the positioning portions 1612 are against the front side wall of the second circuit board 150. The rear end of the cable 30 is passed through the tubular portion 162, until the rear side of the fixing portion 311 is against the first end 1621 of the tubular portion 162 and the front plate portion 161 is received and fixed in the second end 1622 of the tubular portion 162 and the holding portion 312 is received in the opening of the first end 1621. The front plate portion 161 and the fixing portion 311 are respectively fixed on the first end 1621 and the second end 1622 by glue. The translucent portion 1610 is exposed from the opening of the second end 1622, and the light emitted by the luminous element 152 can pass through the translucent portion 1610 to irradiate the mating area in which the cable connector assembly 100 is inserted into of a mobile electronic device.

In the embodiment, the second circuit board 150 is fixed on the metal shell 140 by lock. In other embodiment, the second circuit board 150 is vertically fixed by other suitable means. The second circuit board 150 is vertically fixed on the metal shell 140. In this way, the light emitted by the luminous element 152 passes through the translucent portion 1610 directly to illuminate the mating area.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

a first connector having a main body, a plurality of contacts retained in the main body, a first circuit board electrically connected to the contacts, and a metal shell enclosing the first circuit board;

a cable electrically connected between the first circuit board and a power source to provide a power to the first circuit board;

a second circuit board vertically fixed on the metal shell;

a cover enclosing the first and the second circuit boards;

a luminous element disposed on a front side of the second circuit board and electrically connected to the first circuit board; and a translucent portion defined on a front end of the cover to pass the light emitted by the luminous element.

2. The cable connector assembly as recited in claim 1, wherein the cover includes a tubular portion and a front plate portion fixed on a front end of the tubular portion, and the translucent portion is defined on the front plate portion or forms the entire front plate portion.

3. The cable connector assembly as recited in claim 2, wherein:

the tubular portion encloses the first circuit board, the main body, and the second circuit board;

the cable is exposed from a rear opening of the tubular portion;

the front plate portion is received in a front opening of the tubular portion; and a through hole is defined on the front plate portion for exposing the main body.

4. The cable connector assembly as recited in claim 2, wherein the metal shell includes a fixing plate, a through hole is defined on the second circuit board, a notch is defined on the inner edge of the second circuit board, the metal shell is received in the through hole of the second circuit board, and the fixing plate is received in the notch.

5. The cable connector assembly as recited in claim 4, wherein the first connector includes an inner mold enclosing the first circuit board and a conjunction portion of the first circuit board and the cable, and the cover encloses the inner mold.

6. The cable connector assembly as recited in claim 4, wherein the front plate portion has on a rear side thereof a plurality of positioning portions bearing against a front side of the second circuit board.

7. The cable connector assembly as recited in claim 1, further including a second connector electrically connected with the cable.

8. The cable connector assembly as recited in claim 7, wherein the first connector is a lighting connector and the second connector is a USB connector.

9. A cable connector assembly comprising:

a cable including at least two wires therein;

an electrical connector connected at one end of the cable along a front-to-back direction, and including a rectangular main body defining exposed opposite surfaces with thereon a plurality of contacts exposed to an exterior in a vertical direction perpendicular to said front-to-back direction;

a metallic shell located upon a rear end of the main body;

a vertical printed circuit board defining a through hole in the front-to-back direction to receive the metallic shell;

a luminous element mounted upon the vertical printed circuit board;

a cover assembled including a front plate portion with a through hole in the front-to-back direction to receive the main body therein, and a rear tubular portion located behind the front plate portion and enclosing the vertical printed circuit board; wherein the front plate portion is at least partially translucent to transmit light generated from the luminous element.

10. The cable connector assembly as claimed in claim 9, wherein the front plate portion is further equipped with positioning portions to retain to the metallic shell.

11. The cable connector assembly as claimed in claim 10, wherein the metallic shell forms a fixing plate extending in the front-to-back direction and retained by the positioning portion.

12. The cable connector assembly as claimed in claim 11, wherein the vertical printed circuit board forms a notch, and the metallic shell forms a fixing plate extending along the front-to-back direction and received in the notch.

13. The cable connector assembly as claimed in claim 9, further including a horizontal printed circuit board extending rearwardly around the metallic shell, to which the contacts are electrically and mechanically connected.

14. The cable connector assembly as claimed in claim 13, further including an inner mold applied upon the horizontal printed circuit board, intimately located behind the vertical printed circuit board and enclosed in the tubular portion.

15. The cable connector assembly as claimed in claim 9, wherein the front plate portion is further equipped with positioning portions alternately arranged with the luminous elements around the metallic shell.

16. A cable connector assembly comprising:

a main body with a plurality of contacts exposed thereon to communicate with an exterior;

a horizontal printed circuit board extending rearwardly behind the main body in a front-to-back direction, and mechanically and electrically connected to the contacts;

a vertical printed circuit board surrounding a rear portion of the main body;

a plurality of luminous elements mounted upon the vertical printed circuit board; and a cover positioned in front of the vertical printed circuit board; wherein said cover includes a front plate portion which is at least partially translucent.

17. The cable connector assembly as claimed in claim 16, wherein said front plate is equipped with a plurality of positioning portions alternately arranged with the corresponding luminous elements around the metallic shell.

18. The cable connector assembly as claimed in claim 17, further including a metallic shell on which the vertical printed circuit board is attached.

19. The cable connector assembly as claimed in claim 18, wherein the positioning portions are retained to the metallic shell.

20. The cable connector assembly as claimed in claim 19, further including an inner mold applied upon the horizontal printed circuit board, and the cover further includes a tubular portion behind the front plate portion to enclose said inner mold.

* * * * *